US011898829B2

(12) United States Patent
Graham

(10) Patent No.: US 11,898,829 B2
(45) Date of Patent: Feb. 13, 2024

(54) ACCELERATION INITIATED ENDOTHERMIC REACTION

(71) Applicant: Simmonds Precision Products, Inc., Vergennes, VT (US)

(72) Inventor: Jason Graham, Prior Lake, MN (US)

(73) Assignee: Simmonds Precision Products, Inc., Vergennes, VT (US)

( * ) Notice: Subject to any disclaimer, the term of this patent is extended or adjusted under 35 U.S.C. 154(b) by 601 days.

(21) Appl. No.: 17/104,222

(22) Filed: Nov. 25, 2020

(65) Prior Publication Data

US 2022/0163305 A1 May 26, 2022

(51) Int. Cl.
*F42B 15/34* (2006.01)
*F25D 5/00* (2006.01)

(52) U.S. Cl.
CPC ..... *F42B 15/34* (2013.01); *F25D 5/00* (2013.01)

(58) Field of Classification Search
CPC ..... F42B 15/34; F25D 5/00; F25D 5/02
See application file for complete search history.

(56) References Cited

U.S. PATENT DOCUMENTS 4,427,010 A * 1/1984 Marx ..... A61F 7/106 607/114
4,791,850 A * 12/1988 Minovitch ..... F42B 6/006 89/8
4,800,141 A 1/1989 Eppley et al.
4,834,802 A * 5/1989 Prier ..... A61F 7/03 604/113
4,861,686 A 8/1989 Snyder
5,187,939 A * 2/1993 Skertic ..... F25D 19/006 250/352
5,257,755 A * 11/1993 Moser ..... F25D 5/00 102/293
7,504,177 B2 3/2009 Peabody
11,656,019 B2 * 5/2023 Iatrides ..... B01J 16/00 62/411
2012/0144845 A1 * 6/2012 Leavitt ..... F25D 5/02 62/4
2012/0145716 A1 6/2012 Thomas et al.
2018/0132383 A1 * 5/2018 Howe ..... H05K 7/20518

* cited by examiner

*Primary Examiner* — Bret Hayes
(74) *Attorney, Agent, or Firm* — Locke Lord LLP; Joshua L. Jones; Scott D. Wofsy

(57) ABSTRACT

A system includes a guided munition having a housing. A first reservoir is defined within the housing holding a first chemical reactant. A second reservoir is defined within the housing, wherein the second reservoir holds a second chemical reactant configured to undergo an endothermic reaction with the first chemical reactant. A frangible barrier separates between the first and second reservoirs. The frangible barrier is configured to break under forces acting on the guided munition as the guided munition is fired from a weapon. An electronic device can be housed within the housing in thermal contact with at least one of the first reservoir and/or second reservoir for cooling the electronic device with an endothermic reaction upon mixing of the first and second chemical reactants.

15 Claims, 3 Drawing Sheets

ACCELERATION INITIATED ENDOTHERMIC REACTION

STATEMENT REGARDING FEDERALLY SPONSORED RESEARCH OR DEVELOPMENT

This invention was made with government support under contract number 2019-535 awarded by the U.S. ARMY. The government has certain rights in the invention.

BACKGROUND

1. Field

The present disclosure relates to heat transfer in hardened electronics, and more particularly to hardened electronics such as used in guided munitions.

2. Description of Related Art

There is an ever increasing need for smaller SWAP (size, weight and power) of electronics in guided munitions. As the size of these electronics decreases, the power density can drastically increase, resulting in the ever increasing need for new thermal mitigation techniques. Heatsinks or heatpipes can be used in conjunction with guided munitions to transport heat in cooling the electronics. Thermoelectric coolers (TECs) can be too weak mechanically and can therefore be unable to survive high acceleration events. Also with the desire to limit power consumption to the active electronics and potentially a limit on maximum power resources available, it is not desirable to use active cooling techniques that require power.

The conventional techniques have been considered satisfactory for their intended purpose. However, there is an ever present need for improved systems and methods for cooling electronics in guided munitions. This disclosure provides a solution for this need.

SUMMARY

A system includes a guided munition having a housing. A first reservoir is defined within the housing holding a first chemical reactant. A second reservoir is defined within the housing, wherein the second reservoir holds a second chemical reactant configured to undergo an endothermic reaction with the first chemical reactant. A frangible barrier separates between the first and second reservoirs. The frangible barrier is configured to break under forces acting on the guided munition as the guided munition is fired from a weapon.

An electronic device can be housed within the housing in thermal contact with at least one of the first reservoir and/or second reservoir for cooling the electronic device with an endothermic reaction upon mixing of the first and second chemical reactants. A mass can be included within the first reservoir configured to assist with breaking the barrier as acceleration forces the mass toward the second reservoir. The mass can be a free mass within the first reservoir. A fixed mass can be included in the second reservoir positioned so the free mass moves past the fixed mass as acceleration forces the free mass toward the second reservoir. The fixed mass can assist the free mass in breaking the frangible barrier from opposite sides. The free mass can be ring shaped and can be positioned to surround the fixed mass as acceleration forces the free mass toward the second reservoir. The free mass can be connected to a biasing member, which can be connected to the housing to hold the free mass away from the frangible barrier prior to acceleration forcing the free mass toward the second reservoir. The fixed mass can be connected to a biasing member which is connected to the housing to keep the fixed mass away from the frangible barrier prior to acceleration forcing the free mass toward the second reservoir, wherein the fixed mass is configured to compress its biasing member and become fixed relative to the housing as acceleration forces the free mass toward the second reservoir. At least one of the free mass and/or the fixed mass can include an edge or point configured to penetrate the frangible barrier.

A guided munition includes a housing with a cooling system inside the housing for cooling an internal electronic device inside the housing, wherein the cooling system is passively activated by firing the guided munition as a projectile from a weapon.

A method includes breaking a frangible barrier under forces acting on a housing of a guided munition as the guided munition is fired from a weapon. The method includes mixing a first chemical reactant from a first reservoir within the housing with a second chemical reactant from a second reservoir within the housing to cause an endothermic reaction wherein breaking the frangible barrier brings the first and second chemical reactants into contact with one another.

The method can include cooling an electronic device within the housing using the endothermic reaction. The method can include assisting mixing of the first and second chemical reactants using motion from rifling and balloting in the weapon. Breaking the frangible barrier can include using a mass within the first reservoir configured to assist with breaking the barrier as acceleration forces the mass toward the second reservoir. The mass can be a free mass within the first reservoir and a fixed mass can be included in the second reservoir positioned so the free mass moves to pass the fixed mass as acceleration forces the free mass toward the second reservoir, wherein the fixed mass assists the free mass in breaking the frangible barrier from opposite sides. The free mass can be ring shaped and is positioned to surround the fixed mass as acceleration forces the free mass toward the second reservoir.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
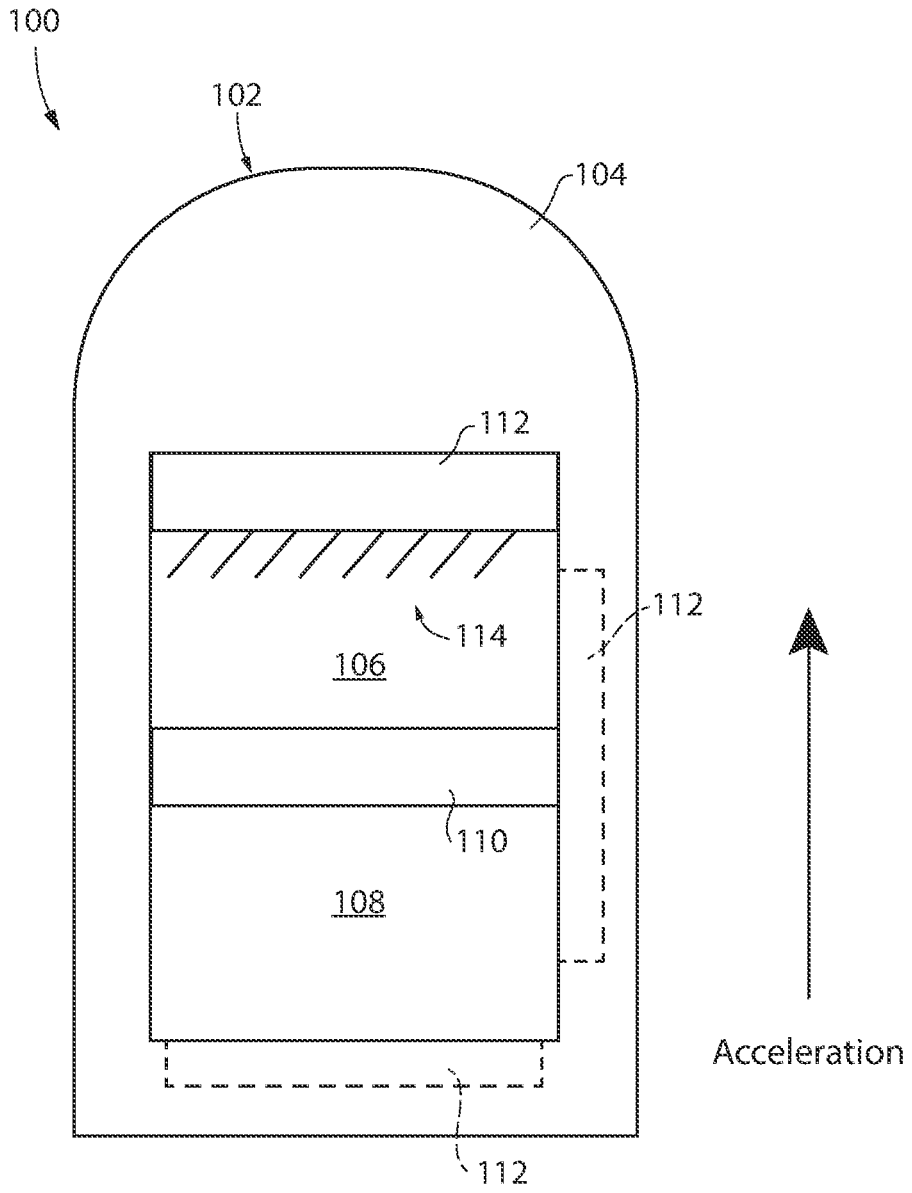
FIG. 1 is a schematic view of an embodiment of a system constructed in accordance with the present disclosure, showing the frangible barrier separating the first and second reservoirs in a guided munition housing.

Reference will now be made to the drawings wherein like reference numerals identify similar structural features or aspects of the subject disclosure. For purposes of explanation and illustration, and not limitation, a partial view of an embodiment of a system in accordance with the disclosure is shown in FIG. 1 and is designated generally by reference character 100. Other embodiments of systems in accordance with the disclosure, or aspects thereof, are provided in FIGS. 2-5, as will be described. The systems and methods described herein can be used to provide self-contained, passively activated electronic cooling for guided munitions.

The system 100 includes a guided munition 102 having a housing 104. A first reservoir 106 is defined within the housing 104 holding a first chemical reactant. A second reservoir 108 is defined within the housing 104, wherein the second reservoir 108 holds a second chemical reactant configured to undergo an endothermic reaction with the first chemical reactant. A frangible barrier 110 separates between the first and second reservoirs 106, 108. The frangible barrier 110 is configured to break under forces acting on the guided munition as the guided munition is fired from a weapon, e.g. acceleration forces under acceleration in the direction indicated by the larger arrow in FIG. 1.

An electronic device 112 is housed within the housing 104 in thermal contact with at least one of the first reservoir 106 and/or second reservoir 108 for cooling the electronic device 112 with an endothermic reaction upon mixing of the first and second chemical reactants. As indicated in FIG. 1 with dashed lines, while the electronic device is shown in direct thermal contact only with the first reservoir 106, the electronic device 112 can also be located in thermal contact with both reservoirs 106, 108, or only with the second reservoir 108, or can be in the center and surrounded on its periphery by the first and second chemical reactants. The electronic device 112 can include a heat exchanger structure, such as fins 114.

Figure 2:
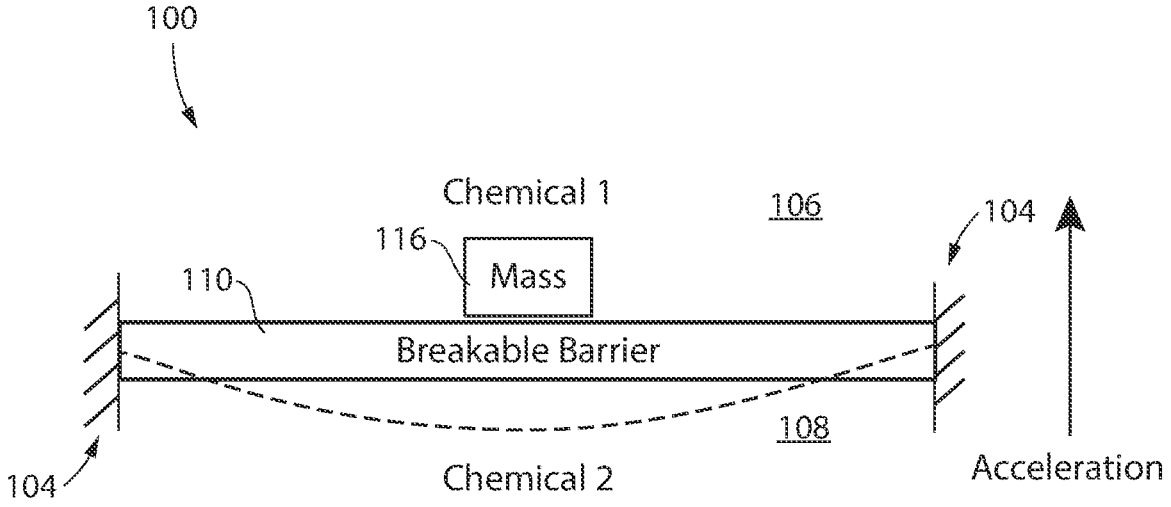
FIG. 2 is a schematic view of the system of FIG. 1, showing an embodiment of a free mass for assisting in breaking the frangible barrier.

With reference now to FIG. 2, a mass 116 can be included within the first reservoir 106 configured to assist with breaking the barrier 110 as acceleration forces the mass 116 toward the second reservoir 108, where the deflection of the barrier 110 prior to breaking is indicated symbolically in FIG. 2 with a dashed line. The mass 116 is a free mass within the first reservoir 106.

Figure 3:
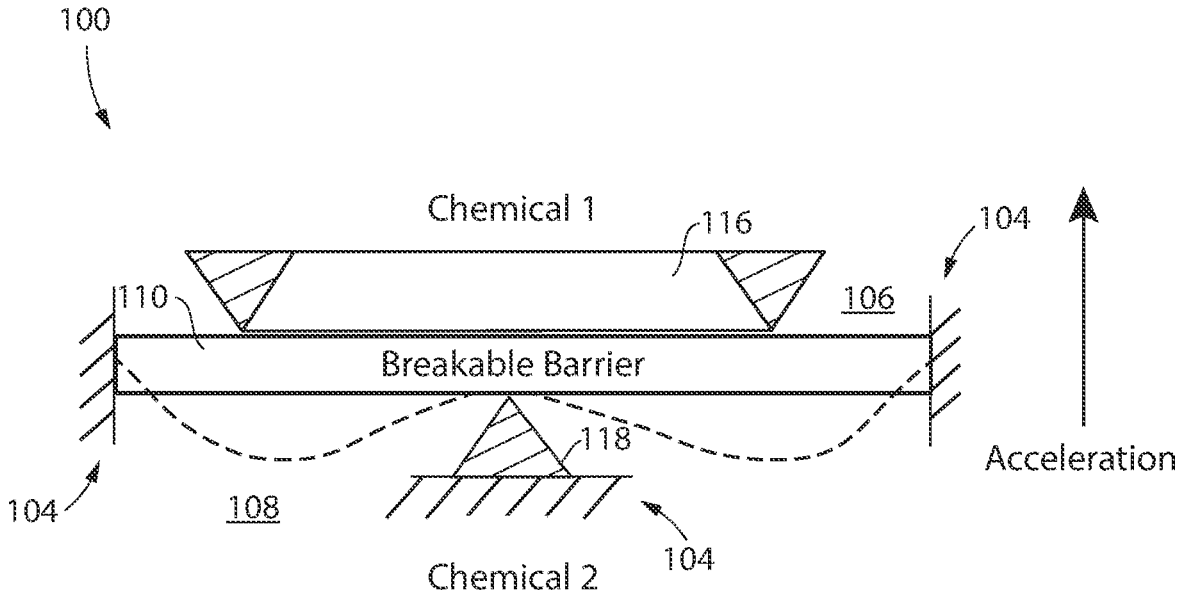
FIG. 3 is a schematic view of the system of FIG. 1, showing an embodiment of a free mass that is ring shaped.

With reference now to FIG. 3, a fixed mass 118 can be included in the second reservoir 108 positioned so the free mass 116 (e.g. a ring-shaped free mass 116) moves past the fixed mass 118 as acceleration forces the free mass 116 toward the second reservoir 108. The fixed mass 118 assists the free mass 116 in breaking the frangible barrier 110 from opposite sides, where the deflection of the barrier 110 prior to breaking is symbolically shown in FIG. 3 with a dashed line. The is ring shaped free mass 116 is positioned to surround the fixed mass 118 as acceleration forces the free mass 116 toward the second reservoir 108.

Figure 4:
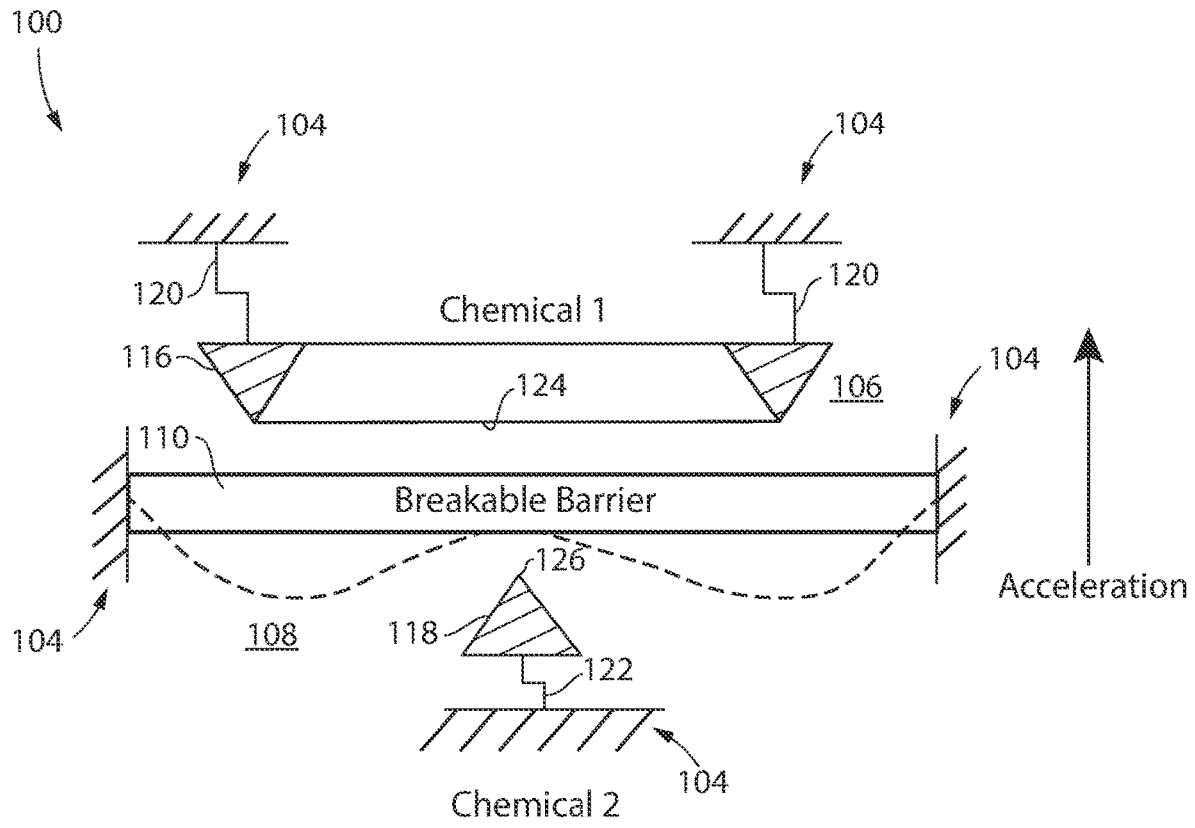
FIG. 4 is a schematic view of the system of FIG. 3, showing the free mass connected to a biasing member.

With reference now to FIG. 4, the free mass 116 can be connected to a biasing member 120, which is connected to the housing 104 to hold the free mass 116 away from the frangible barrier 110 prior to acceleration forcing the free mass 116 toward the second reservoir 108. The fixed mass 118 can similarly be connected to a biasing member 122 which is connected to the housing 104 to keep the fixed mass 118 away from the frangible barrier 110 prior to acceleration forcing the free mass 116 toward the second reservoir 108. The fixed mass 118 is configured to compress its biasing member 122 and become fixed relative to the housing 104 as acceleration forces the free mass 116 toward the second reservoir 108. Each of the free mass 116 and/or the fixed mass 118 can include a sharp edge 124 or point 126 configured to penetrate the frangible barrier 110.

Figure 5:
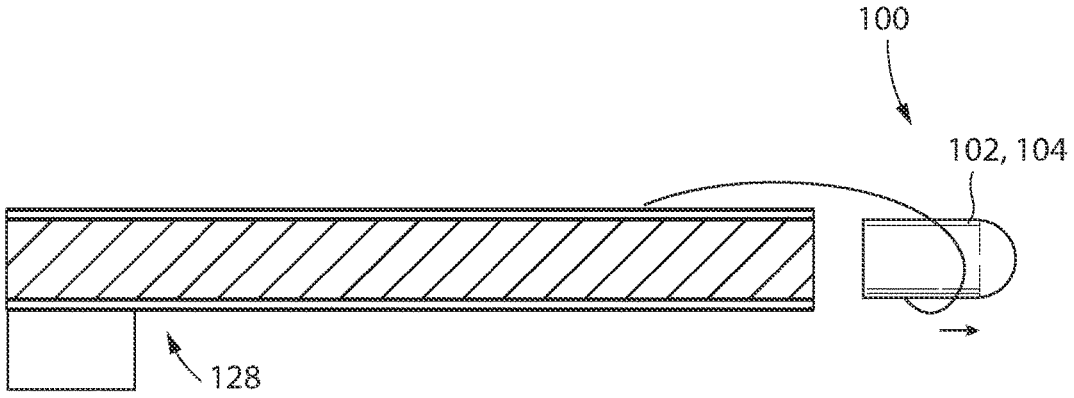
FIG. 5 is a schematic view of the system of FIG. 1, showing the guided munition accelerating through a weapon with rifling and balloting.

With reference to FIG. 5, the guided munition 102 described herein has a cooling system self-contained within the housing 104, wherein the cooling system is passively activated by acceleration forces generated by firing the guided munition 102 as a projectile from a weapon 128. The frangible barrier 110 shown in FIG. 1 breaks, under the acceleration forces, allowing mixing of the first chemical reactant with the second chemical reactant to cause an endothermic reaction. The barrier 110 can be disintegrated. Breaking the frangible barrier 110 shown in FIG. 1 brings the first and second chemical reactants into contact with one another. The endothermic reaction can be used for cooling an electronic device 112 of FIG. 1. The method can include assisting mixing of the first and second chemical reactants using motion from rifling and balloting 130 in the weapon 128 or other perturbations incident to the motion of the guided munition 102. The barrier 110 keeps the two chemical reactants separated for storage until the guided munition 102 is fired from a weapon 128.

The methods and systems of the present disclosure, as described above and shown in the drawings, provide for self-contained, passively activated electronic cooling for guided munitions. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A system comprising:

a guided munition including a housing;

a first reservoir within the housing holding a first chemical reactant;

a second reservoir within the housing, wherein the second reservoir holds a second chemical reactant configured to undergo an endothermic reaction with the first chemical reactant; and a frangible barrier separating between the first and second reservoirs, wherein the frangible barrier is configured to break under forces acting on the guided munition as the guided munition is fired from a weapon.

2. The system as recited in claim 1, further comprising an electronic device housed within the housing in thermal contact with at least one of the first reservoir and/or second reservoir for cooling the electronic device with an endothermic reaction upon mixing of the first and second chemical reactants.

3. The system as recited in claim 1, further comprising a mass within the first reservoir configured to assist with breaking the barrier as acceleration forces the mass toward the second reservoir.

4. The system as recited in claim 3, wherein the mass is a free mass within the first reservoir and further comprising a fixed mass in the second reservoir positioned so the free mass moves past the fixed mass as acceleration forces the free mass toward the second reservoir, wherein the fixed mass assists the free mass in breaking the frangible barrier from opposite sides.

5. The system as recited in claim 4, wherein the free mass is ring shaped and is positioned to surround the fixed mass as acceleration forces the free mass toward the second reservoir.

6. The system as recited in claim 4, wherein the free mass is connected to a biasing member, which is connected to the housing to hold the free mass away from the frangible barrier prior to acceleration forcing the free mass toward the second reservoir.

7. The system as recited in claim 6, wherein the fixed mass is connected to a biasing member which is connected to the housing to keep the fixed mass away from the frangible barrier prior to acceleration forcing the free mass toward the second reservoir, wherein the fixed mass is configured to compress its biasing member and become fixed relative to the housing as acceleration forces the free mass toward the second reservoir.

8. The system as recited in claim 3, wherein at least one of the free mass and/or the fixed mass include an edge or point configured to penetrate the frangible barrier.

9. A guided munition including a housing with a cooling system inside the housing for cooling an internal electronic device inside the housing, wherein the cooling system is passively activated by firing the guided munition as a projectile, wherein a frangible barrier separates between first and second reservoirs, wherein the frangible barrier is configured to break under forces acting on the guided munition as the guided munition is fired from a weapon.

10. A method comprising:

breaking a frangible barrier under forces acting on a housing of a guided munition as the guided munition is fired from a weapon; and mixing a first chemical reactant from a first reservoir within the housing with a second chemical reactant from a second reservoir within the housing to cause an endothermic reaction wherein breaking the frangible barrier brings the first and second chemical reactants into contact with one another.

11. The method as recited in claim 10, further comprising cooling an electronic device within the housing using the endothermic reaction.

12. The method as recited in claim 10, further comprising assisting mixing of the first and second chemical reactants using motion from rifling and balloting in the weapon.

13. The method as recited in claim 10, wherein breaking the frangible barrier includes using a mass within the first reservoir configured to assist with breaking the barrier as acceleration forces the mass toward the second reservoir.

14. The method as recited in claim 13, wherein the mass is a free mass within the first reservoir and further comprising a fixed mass in the second reservoir positioned so the free mass moves past the fixed mass as acceleration forces the free mass toward the second reservoir, wherein the fixed mass assists the free mass in breaking the frangible barrier from opposite sides.

15. The method as recited in claim 14, wherein the free mass is ring shaped and is positioned to surround the fixed mass as acceleration forces the free mass toward the second reservoir.

* * * * *